US006582040B2

(12) United States Patent
Coven et al.

(10) Patent No.: US 6,582,040 B2
(45) Date of Patent: Jun. 24, 2003

(54) METHOD OF EJECTING FLUID FROM AN EJECTION DEVICE

(75) Inventors: Patrick J Coven, Albany, OR (US); Satya Prakash, Poway, CA (US); Mark S Barbour, Corvallis, OR (US)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/967,079

(22) Filed: Sep. 28, 2001

(65) Prior Publication Data

US 2003/0063143 A1 Apr. 3, 2003

(51) Int. Cl.[7] ..... B41J 29/38
(52) U.S. Cl. ..... 347/11; 347/10
(58) Field of Search ..... 347/10, 11

(56) References Cited

U.S. PATENT DOCUMENTS 5,600,349 A * 2/1997 Keefe ..... 347/11
6,126,260 A * 10/2000 Lan et al. ..... 347/1

FOREIGN PATENT DOCUMENTS

| | | | |
|---|---|---|---|
| JP | 05092565 A2 | 4/1993 | ..... B41J/2/05 |
| JP | 2001038926 | 2/2001 | ..... B41J/2/05 |
| JP | 2001038927 | 2/2001 | ..... B41J/5/05 |

* cited by examiner

*Primary Examiner*—John Barlow
*Assistant Examiner*—Alfred E. Dudding

(57) ABSTRACT

A method of ejecting fluid from an ejection device is described. This method includes adding fluid to a firing chamber, and passing a first amount of charge through a heating element of the firing chamber. The first amount of charge causes the heating element to emit a first quantity of thermal energy, thereby forming a vapor bubble in fluid adjacent the heating element to eject fluid from the firing chamber. A second amount of charge is passed through the heating element to cause the heating element to emit a second amount of thermal energy that is insufficient to eject fluid from the firing chamber.

19 Claims, 3 Drawing Sheets

METHOD OF EJECTING FLUID FROM AN EJECTION DEVICE

TECHNICAL FIELD

The present invention relates generally to a method of ejecting fluid from an ejection device.

BACKGROUND

In contrast to many other types of printers, inkjet printers provide fast, high resolution, black-and-white and color printing on a wide variety of media and at a relatively low cost. As a result, inkjet printers have become one of the most popular types of printers for both consumer and business applications. Nevertheless, printer technology continuously advances to keep pace with ever-increasing customer demands for printers that print faster, at a higher resolution, and at a lower cost.

The printhead of the printer controls the application of ink to the printing medium (e.g., paper). Generally, printheads include a plurality of ink ejection mechanisms formed on a substrate. Each ink ejection mechanism includes a firing chamber with at least one ejection orifice. Each ink ejection mechanism also includes one or more firing resistors (or heating elements), located in the firing chamber. The substrate is connected to an ink cartridge or other ink supply. Channel structures formed on the substrate direct the ink from the ink supply to the firing chambers. Control circuitry, located on the substrate and/or remote from the substrate, supplies current to the firing resistors in selected firing chambers. The ink within the selected chambers is superheated by the firing resistors, causing the ink in close proximity to the resistors to be vaporized. This forms a drive bubble that pushes ink through the chamber orifice toward the printing medium in the form of an ink droplet.

One problem that may occur in printheads is damage to the firing resistors caused by residual ink collapsing back into the chamber, and thus onto the resistor, after the collapse of the bubble. Several structural approaches have been developed to alleviate this problem. For example, one approach involves forming the firing resistors of thicker layers that are less vulnerable to mechanical stress and impact. Another approach involves forming a protective layer or layers over the resistors to absorb the impact. However, both approaches increase the thermal mass that is heated to eject the ink, and thus may decrease the thermal efficiency of the ink ejection mechanism. Furthermore, additional protective layers increase the complexity and cost of manufacturing the printheads.

SUMMARY

In one embodiment, a method of ejecting fluid from an ejection device is described. This method includes adding fluid to a firing chamber, and passing a first amount of charge through a heating element of the firing chamber. The first amount of charge causes the heating element to emit a first quantity of thermal energy, thereby forming a vapor bubble in fluid adjacent the heating element to eject fluid from the firing chamber. A second amount of charge is passed through the heating element to cause the heating element to emit a second amount of thermal energy that is insufficient to eject fluid from the firing chamber.

Many of the attendant features of this invention will be more readily appreciated as the same becomes better understood by reference to the following detailed description and considered in connection with the accompanying drawings in which like reference symbols designate like parts throughout.

DETAILED DESCRIPTION

Figure 1:
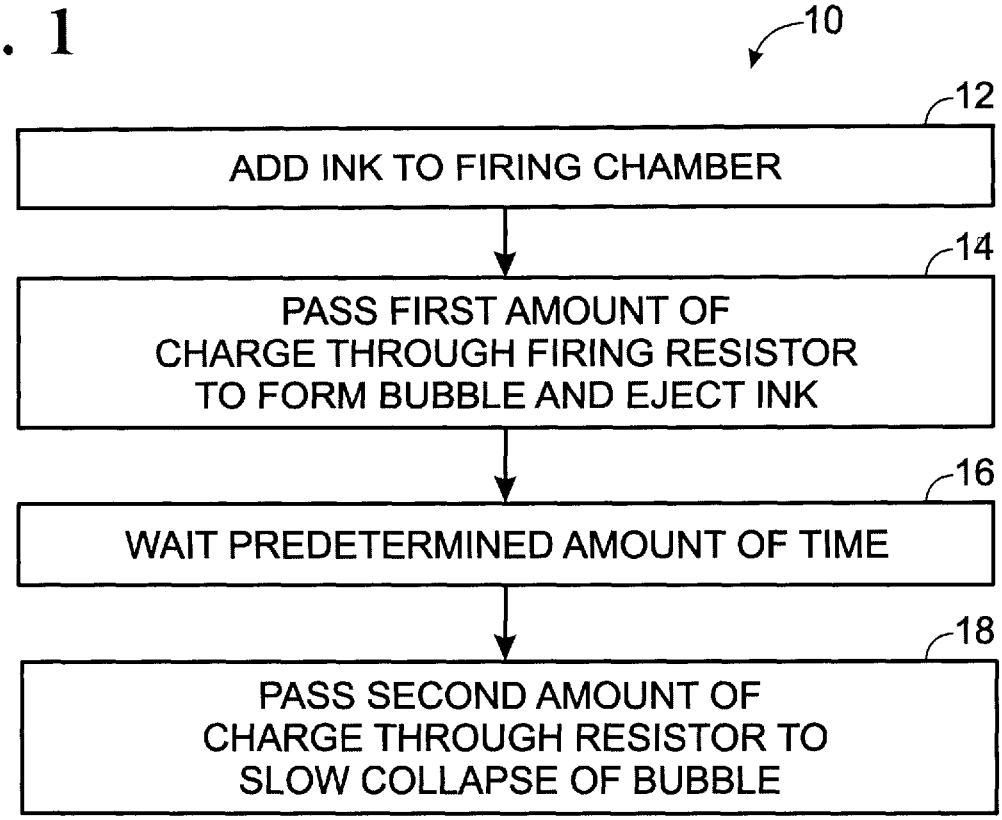
FIG. 1 is a flow diagram of a first embodiment of a method of ejecting ink from an inkjet printhead according to the present invention.

A first embodiment of a method for ejecting ink from a thermal inkjet printhead according to the present invention is depicted generally at 10 in FIG. 1. As indicated, method 10 begins with filling a firing chamber of a printhead with ink at 12, and then passing a first amount of charge through a firing resistor, at 14, by applying a drive pulse across the firing resistor. Passing the first amount of charge through the firing resistor causes the firing resistor to emit a first quantity of thermal energy, thereby forming a bubble of vaporized ink to drive ink out of the printhead.

Next, the resistor is allowed to cool for a predetermined amount of time at 16, during which time the vapor bubble begins to collapse. After waiting the predetermined amount of time, a second amount of charge is passed through the firing resistor, at 18, by applying a successor pulse across the firing resistor. This second amount of charge causes the firing resistor to emit a second quantity of thermal energy.

The second quantity of thermal energy is insufficient to eject another drop of ink, but is sufficient to slow the collapse of the bubble, or perhaps to redirect the impact of ink resulting from such bubble collapse. In either event, the bubble collapse results in less impact on the firing resistor than there would be in the absence of the successor pulse. This may reduce damage to the resistor caused by bubble collapse, and thereby increase lifetime of the firing resistor. While the drive pulse and successor pulse are separated in the depicted embodiment, it will be appreciated that the successor pulse also may immediately follow the drive pulse without departing from the scope of the invention.

Figure 2:
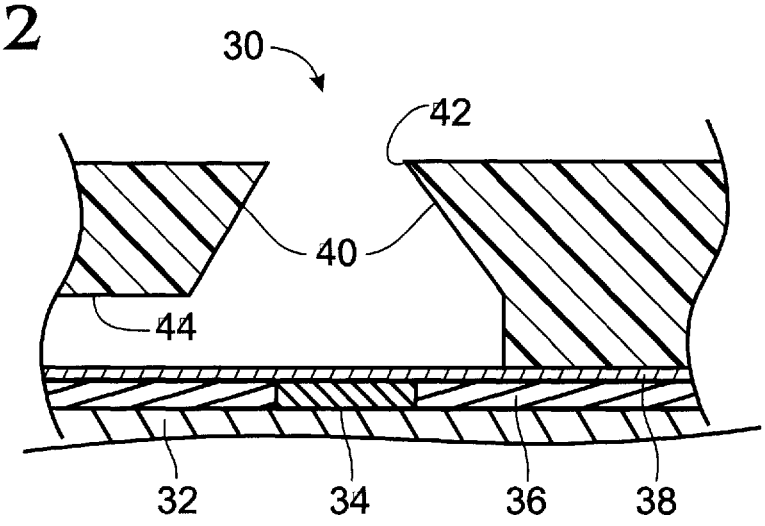
FIG. 2 is an enlarged sectional view of an exemplary firing chamber of a printhead.

FIG. 2 is a somewhat simplified representation of a firing chamber of a typical printhead, the firing chamber being indicated generally at 30. Firing chamber 30 is formed on a suitable substrate 32, typically silicon. A firing resistor 34, formed from a layer of a resistive material deposited and patterned on substrate 32, is positioned at the bottom of firing chamber 30. Firing chamber 30 also has a conductive layer 36 in electrical communication with firing resistor 34 for conducting current to the firing resistor. Conductive layer 36 and firing resistor 34 may be covered with one or more suitable passivation layers 38. For example, if firing chamber 30 is to be used to print with electrically conductive ink, an electrical/chemical passivation layer may be used. Additionally, a mechanical passivation layer may be used to help absorb impact on firing resistor 34. In one embodiment, the one or more suitable passivation layers 38 define the bottom surface of the firing chamber.

The sides of firing chamber 30 are formed from one or more walls 40, depending upon the shape of the firing chamber. Walls 40 typically taper inwardly to form an orifice 42, through which ink is ejected. An ink delivery channel 44 is provided for delivering ink to firing chamber 30 to refill the firing chamber after ejection of an ink droplet. In the depicted embodiment, orifice 42 is centered over firing resistor 34, as is common in many printheads. With this configuration, residual ink may directly impact the area above firing resistor 34 as the bubble collapses after ink droplet ejection, and thus may damage the firing resistor.

Figure 3:
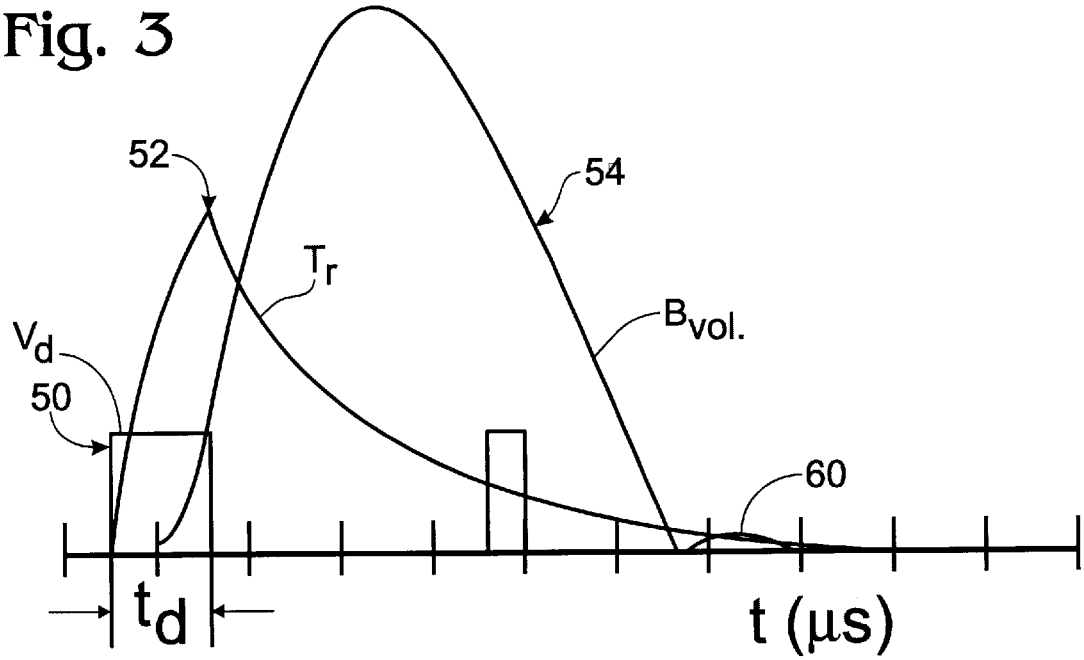
FIG. 3 is a graph showing temperature of a printhead firing resistor and volume of a bubble in a printhead firing chamber as a function of time, without use of a successor pulse.

FIG. 3 is a graphical representation of a drive pulse (without the use of a successor pulse) to a firing resistor in a printhead firing chamber, along with representations of resulting resistor temperature as a function of time, and bubble volume as a function of time. The horizontal axis in FIG. 3 represents time in microseconds. The vertical scales of plotted variables are qualitative only, and do not represent any relative magnitudes between the variables.

First, a drive pulse for heating firing resistor 34 is depicted at 50. Drive pulse 50 has a voltage ($V_d$) and is configured to generate enough thermal energy to vaporize ink at a very rapid rate. The approximate amount of thermal energy dissipated by firing resistor 34 when a voltage pulse is applied across the resistor is given by:

$$E=V^2t/R \quad (1)$$

where V is the voltage of the pulse, t is the duration of the pulse, and R is the resistance of the firing resistor.

The amount of thermal energy used to form the ink bubble will vary depending upon the geometry and thermal mass of the firing chamber. In one embodiment, the amount of thermal energy used to form the bubble ranges from about 0.4 and 4.5 microjoules. In another embodiment, the thermal energy heats the one or more suitable passivation layers 38 until they reach a temperature above the superheat limit of the fluid that is being ejected. For example, one embodiment has 2.5 microjoules of energy to reach the superheat limit. To generate this amount of thermal energy, drive pulse 50, for example, may have a voltage ($V_d$) of approximately 8–9 volts with a duration ($t_d$) of approximately 2 microseconds across a 60 ohm resistor. Drive pulse 50 typically takes the form of a square pulse, but may have any other suitable shape.

Applying drive pulse 50 across firing resistor 34 causes a first charge to flow through the firing resistor. This, in turn, causes firing resistor 34 to increase in temperature and dissipate energy as heat. The amount of heat dissipated is proportional to the drive pulse voltage ($V_d$) and the drive pulse duration ($t_d$), and thus is proportional to the total amount of charge that flows through firing resistor 34.

The temperature of the resistor ($T_r$) as a function of time is shown in FIG. 3 at 52. As will be appreciated upon review of the resistor temperature characteristic shown in FIG. 3, the application of drive pulse 50 across firing resistor 34 causes the firing resistor to heat up rapidly as indicated by resistor temperature characteristic 52. Once drive pulse 50 is removed from firing resistor 34, the firing resistor begins to cool down, albeit at a slower rate than its heating rate. Because of factors such as the heat being transmitted from the resistor through the passivation layers, and the lower thermal conductivity and the higher heat capacity of the ink relative to the firing resistor, changes in the bubble volume ($B_{vol}$), depicted at 54 in FIG. 3, tend to lag somewhat behind changes in the firing resistor temperature. Furthermore, although firing resistor 34 begins to cool as soon as the drive pulse is finished, the bubble expands for several more microseconds. This expansion is the inertial expansion phase of bubble growth.

Approximately 6–8 microseconds after initiating drive pulse 50, the bubble begins to contract as indicated by bubble volume characteristic 54, causing the ink droplet to break off. Finally, approximately 12–15 microseconds after initiating drive pulse 50, the bubble collapses completely, shown in FIG. 3 where the bubble volume characteristic 54 meets the horizontal axis.

A subsequent rebound bubble is shown generally at 60 to demonstrate that bubble volume does not immediately settle at zero. The slope of bubble volume characteristic 54, where it initially meets the horizontal axis, is an indicator of the relative velocity and momentum of residual ink striking the area above the surface of firing resistor 34 after ink droplet ejection. In FIG. 3, the slope of the bubble volume characteristic is fairly steep at this point, indicating that the residual ink strikes the area above firing resistor 34 with a relatively large velocity and momentum.

Figure 4:
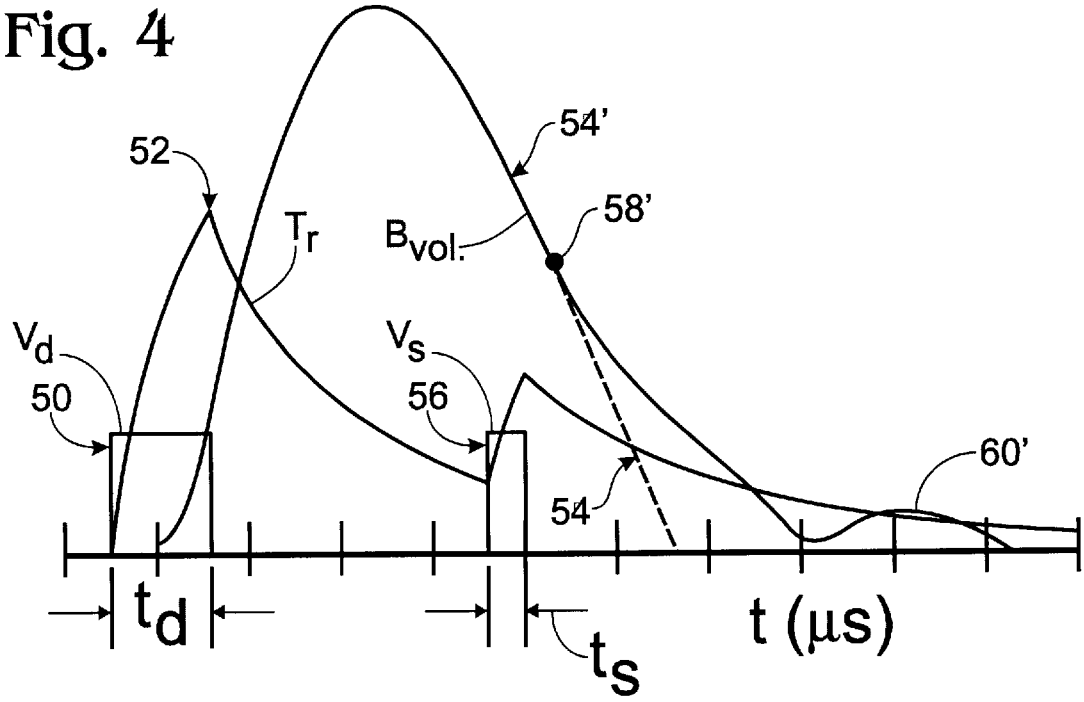
FIG. 4 is a graph showing temperature of a printhead firing resistor and volume of a bubble in a printhead firing chamber as a function of time, with use of a successor pulse.

In contrast, FIG. 4 is a graphical representation of a drive pulse 50 and a successor pulse 56 of a firing resistor in a printhead firing chamber, along with representations of resulting resistor temperature as a function of time and bubble volume as a function of time. In the depicted embodiment, after completion of drive pulse 50, no voltage is applied across firing resistor 34 for a predetermined amount of time. This period of time is typically approximately 5 to 15 microseconds, and more typically approximately 6–9 microseconds, although periods of time outside of these ranges may also be used.

After the predetermined amount of time, successor pulse 56 is applied across firing resistor 34. Successor pulse 56 causes firing resistor temperature ($T_r$) to spike upwardly for the duration of the pulse as indicated, after which the firing resistor temperature ($T_r$) again begins to cool. At least a portion of the heat generated by successor pulse 56 is absorbed by the ink vapor in the collapsing bubble. This causes the bubble to cool more slowly, and collapse less rapidly, as shown subsequent to inflection point 58' on bubble volume characteristic 54'.

After first inflection point 58', the rate of collapse of the bubble briefly slows as indicated on bubble volume characteristic, and then begins to accelerate again. Although bubble collapse does speed up after the heat from successor pulse 56 has been absorbed by the ink, bubble collapse does not reach as great a velocity and momentum as it would in the absence of a successor pulse indicated by dashed lines at 54'. This is demonstrated in FIG. 4 by the shallower angle at which the bubble volume characteristic meets the horizontal axis relative to this intersection in FIG. 3. In fact, it will be noted that bubble volume characteristic 54' does not immediately reach zero, but rather rebounds at 60' to further slow bubble collapse.

The slower bubble collapse reduces velocity and momentum of ink collapsing onto the area above firing resistor 34, thereby reducing the likelihood of damage to the firing resistor. Furthermore, although not immediately apparent from FIG. 4, successor pulse 56 may alter bubble collapse so as to redirect the resulting impact, thus potentially further reducing likelihood of damage to the firing resistor.

As mentioned above, successor pulse 56 also may be applied across firing resistor 34 immediately after completion of drive pulse 50, for example, by ramping down to a lower voltage that is then held across the firing resistor during collapse of the bubble.

Successor pulse 56 has a voltage ($V_s$) and a duration ($t_s$) suitable to slow collapse of the vapor bubble, and thus to slow velocity and momentum of ink. The duration and voltage of successor pulse 56 may be chosen by first determining a quantity of thermal energy that will slow the bubble collapse to a desired rate, and then calculating possible voltage and duration combinations that will cause firing resistor 34 to emit the desired quantity of thermal energy. However, suitable durations and voltages for successor pulse 56 may also be chosen empirically, or may be based on desired geometries of the vapor bubble as it collapses.

The desired thermal output may be achieved by varying the voltage ($V_s$), the duration ($t_s$), or both the voltage and the duration of successor pulse 56 relative to drive pulse 50. In some instances, the choice of which condition to vary may be dictated by printer design. For example, the design of an older printer that is to be modified to eject ink according to the present invention may not permit voltage across the firing resistors to be easily modified. In this case, it may be preferable to change the duration of the successor pulse to cause the output of the desired quantity of thermal energy. In other situations, the choice of which quantity to vary may be a matter of preference.

Figure 5:
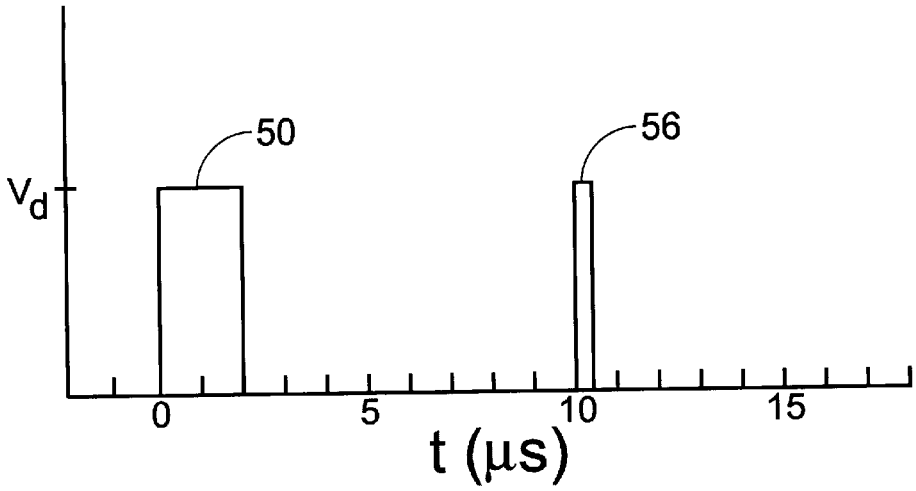
FIG. 5 is a graphical representation of a drive pulse and subsequent successor pulse of a first exemplary voltage and width.
Figure 6:
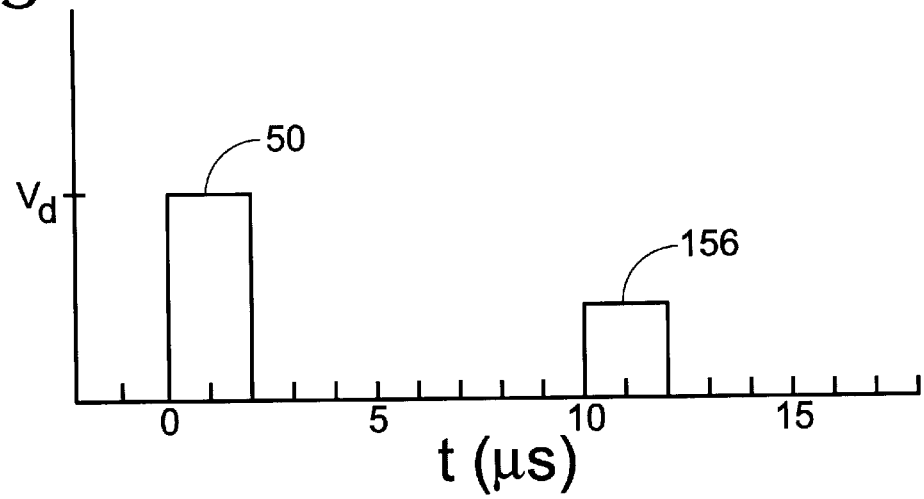
FIG. 6 is a graphical representation of a successor pulse of a drive pulse and subsequent second exemplary voltage and width.
Figure 7:
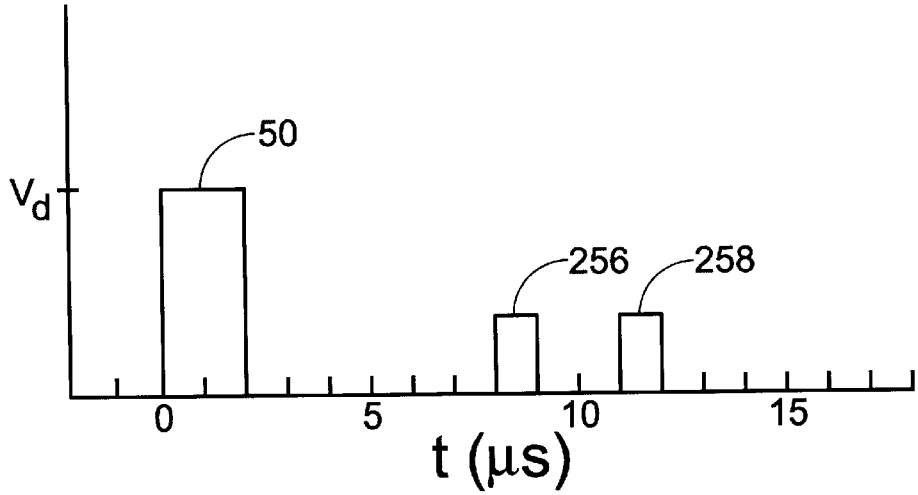
FIG. 7 is a graphical representation of a drive pulse and a subsequent series of individual successor pulses.

FIGS. 5–7 show three different examples of possible drive pulse and successor pulse profiles. In these figures, the horizontal axis represents the pulse duration in microseconds, and the vertical axis represents the pulse voltage. First, FIG. 5 shows a successor pulse 56 having the same voltage as drive pulse 50, but a different duration. In this situation, successor pulse 56 typically will have a shorter duration than drive pulse 50 to effect the emission of a lesser quantity of thermal energy than the drive pulse. For a drive pulse 50 with a duration of approximately 2 microseconds, successor pulse 56 typically will have a duration of approximately 0.1 to 1 microsecond, although durations outside of this range may also be used, for example durations that exceed that of the drive pulse. In one embodiment, the first duration is approximately 0.6 to 2.2 microseconds, and the second duration is approximately 0.1 to 1.0 microsecond. The second duration depends upon how much heat goes into the substrate versus how much heat goes into the vapor, which depends on the specific design of the apparatus.

In contrast, FIG. 6 shows a successor pulse 156 of the same duration as drive pulse 50, but of a different voltage. In this situation, successor pulse 156 will generally have a lower voltage than drive pulse 50. For example, if drive pulse 50 has a voltage of approximately 8 to 9 V, successor pulse 156 typically may have a voltage of approximately 1 to 2 V, although voltages outside this range may also be used.

In the situation where both the voltage and the duration of the successor pulse are modified relative to drive pulse 50, the voltage of the successor pulse may be either higher or lower than the voltage of the drive pulse. Likewise, the duration of the successor pulse may be either longer or shorter than the duration of drive pulse 50. Where the voltage of the successor pulse is higher than the voltage of drive pulse 50, the duration of the successor pulse typically will be shorter than the duration of the drive pulse to keep the thermal energy output of the successor pulse lower than that of the drive pulse. Similarly, wherein the duration of the successor pulse is greater than the duration of drive pulse 50, the voltage of the successor pulse typically will be less than the voltage of the drive pulse.

The rate of bubble collapse may also be controlled by a series of successor pulses, rather than a single successor pulse. In this manner, the rate of bubble collapse can be controlled at more than one different point of the bubble formation and collapse cycle. Such a pulse series may have as many individual pulses as desired.

FIG. 7 shows a successor pulse series having two spaced-apart pulses of equal voltage and duration. As depicted, first successor pulse 256 is applied across firing resistor 34 about 8 microseconds after completion of drive pulse 50, and has a duration of approximately 1 microsecond. Second successor pulse 258 is applied across firing resistor 34 approximately 2 microseconds after completion of first successor pulse 256 and also has a duration of approximately 1 microsecond. It will be understood, however, that these time intervals are merely exemplary, and that first successor pulse 256 may start at any desired time after completion of drive pulse 50. Furthermore, first successor pulse 256 and second successor pulse 258 may be separated by any desired time interval. Moreover, first successor pulse 256 and second successor pulse 258 may be of different voltages and have different durations, if desired.

While the present invention has been particularly shown and described with reference to the foregoing depicted embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

What is claimed is:

1. A method of ejecting fluid from an ejection device firing chamber including a heating element, the method comprising:

adding fluid to the firing chamber;

passing a first amount of charge through the heating element to cause the heating element to emit a first amount of thermal energy, thereby forming a vapor bubble in fluid adjacent the heating element to eject fluid from the firing chamber; and passing a second amount of charge through the heating element to cause the heating element to emit a second amount of thermal energy that is insufficient to eject fluid from the firing chamber, such passing of a second amount of charge through the heating element including applying multiple successor voltage pulses across the heating element.

2. The method of claim 1, wherein the second amount of charge is smaller than the first amount of charge to at least one of slow and alter collapse of the bubble upon ejection of fluid from the firing chamber.

3. The method of claim 1, wherein passing a first amount of charge through the heating element includes applying a first voltage across the heating element, and wherein passing a second amount of charge through the heating element includes applying lesser successor voltages across the heating element.

4. A method of ejecting fluid from a firing chamber of an ejection device, comprising:

adding fluid to the firing chamber;

providing a first pulse of thermal energy of approximately 0.4 to 4.5 microjoules in the firing chamber to cause a bubble to form and expand within the firing chamber, thereby ejecting fluid out of the firing chamber; and providing a second pulse of thermal energy in the firing chamber upon fluid ejection, wherein the second pulse is insufficient to eject fluid from the firing chamber and is of a lesser thermal energy than the thermal energy of the first pulse of thermal energy to at least one of slow and alter collapse of the bubble upon ejection of fluid from the firing chamber.

5. The method of claim 4, wherein the firing chamber includes a heating element, and wherein providing a first pulse of thermal energy and providing a second pulse of thermal energy include applying a first voltage pulse across the heating element and applying a second voltage pulse across the heating element, respectively.

6. The method of claim 4, wherein a collapse of the bubble is altered to protect the firing chamber from damage.

7. The method of claim 4 wherein a layer defines a bottom surface of the firing chamber, wherein the first pulse of thermal energy heats the layer to a temperature at least at the superheat limit of the fluid that is being ejected.

8. The method of claim 4 further comprising waiting a predetermined time interval before providing the second pulse.

9. The method of claim 8, wherein the predetermined time interval is approximately 5 to 15 microseconds.

10. A method of protecting a heating element in an ejection device firing chamber from damage caused by rapid bubble collapse after a fluid ejection operation, the fluid ejection operation including applying a first voltage pulse across the heating element for a first duration to cause the heating element to emit a first thermal energy sufficient to form and expand a bubble to eject fluid out of the firing chamber, the method comprising applying a second voltage pulse, higher than the first voltage pulse, across the heating element for a second duration to cause the heating element to emit a second thermal energy sufficient to at least one of slow and alter collapse of the bubble upon fluid ejection.

11. The method of claim 10, wherein the second thermal energy is less than the first thermal energy.

12. The method of claim 10, wherein the second duration is shorter than the first duration.

13. The method of claim 10, wherein the second voltage pulse is a lower voltage than the first voltage pulse.

14. The method of claim 10, further comprising waiting for a predetermined amount of time after applying the first voltage pulse across the heating element, before applying the second voltage pulse across the heating element.

15. A method of ejecting fluid from an ejection device firing chamber including a heating element, the method comprising:

adding fluid to the firing chamber;

passing a first amount of charge through the heating element by applying a first voltage pulse across the heating element for a first duration to cause the heating element to emit a first amount of thermal energy, thereby forming a vapor bubble in fluid adjacent the heating element to eject fluid from the firing chamber; and passing a second amount of charge through the heating element by applying a second voltage pulse across the heating element for a second duration to cause the heating element to emit a second amount of thermal energy that is insufficient to eject fluid from the firing chamber, the second voltage pulse being of generally constant voltage with the first voltage pulse, and the second duration being shorter than the first duration to at least one of slow and alter collapse of the bubble upon ejection of fluid from the firing chamber.

16. The method of claim 15, wherein the first duration is approximately 0.6 to 2.2 microseconds, and wherein the second duration is approximately 0.1 to 1.0 microsecond.

17. The method of claim 15, further comprising waiting a predetermined amount of time after passing the first amount of charge through the heating element, before passing the second amount of charge through the heating element.

18. The method of claim 17, wherein the predetermined amount of time is approximately 5 to 15 microseconds.

19. A method of protecting a heating element in an ejection device firing chamber from damage caused by rapid bubble collapse after a fluid ejection operation, the fluid ejection operation including applying a first voltage pulse across the heating element for a first duration to cause the heating element to emit a first thermal energy sufficient to form and expand a bubble to eject fluid out of the firing chamber, the method comprising applying a second voltage pulse across the heating element for a second duration to cause the heating element to emit a second thermal energy sufficient to at least one of slow and alter collapse of the bubble upon fluid ejection, and applying a third voltage pulse across the heating element to cause the heating element to emit a third thermal energy sufficient to further at least one of slow and alter collapse of the bubble upon fluid ejection.

* * * * *